United States Patent [19]

Nakamura et al.

[11] Patent Number: 4,726,762

[45] Date of Patent: Feb. 23, 1988

[54] WICK ACTUATING DEVICE FOR THE LEVER ACTUATION TYPE FOR OIL BURNER

[75] Inventors: Kazuharu Nakamura, Aichi; Akiyoshi Okayasu, Gifu, both of Japan

[73] Assignee: Toyotomi Kogyo Co., Ltd., Aichi, Japan

[21] Appl. No.: 869,742

[22] Filed: Jun. 2, 1986

[30] Foreign Application Priority Data

Jun. 3, 1985 [JP] Japan ..... 60-120051

[51] Int. Cl.[4] ..... F23N 5/24

[52] U.S. Cl. ..... 431/88; 431/304; 431/307

[58] Field of Search ..... 431/304, 307, 317, 88, 431/34; 126/45, 96

[56] References Cited

U.S. PATENT DOCUMENTS 4,486,170 12/1984 Tsukada et al. ..... 431/304

*Primary Examiner*—Carroll B. Dority, Jr.

*Attorney, Agent, or Firm*—Pollock, Vande Sande & Priddy

[57] ABSTRACT

A wick actuating device of the lever actuation type for an oil burner is disclosed which is capable of not only vertically moving a wick but variably setting the ignition position of the wick as desired. The wick actuating device includes an operation lever loosely fitted on a wick operating shaft, a shaft actuation lever fixedly fitted on the shaft and a connection mechanism for connecting both levers to each other. The connection mechanism includes a slit formed at the operation lever and a pin slidably mounted on the shaft actuation lever and movably fitted in the slit. The slit is formed to be oblique with respect to the sliding direction of the pin so that the operation lever is engaged with the shaft actuation lever through the slit and pin at an angle which is varied depending upon the position of the pin in the slit.

19 Claims, 4 Drawing Figures

WICK ACTUATING DEVICE FOR THE LEVER ACTUATION TYPE FOR OIL BURNER

BACKGROUND OF THE INVENTION

1. Field of the Invention

This invention relates to a wick actuating device for an oil burner, and more particularly to a wick actuating device of the lever actuation type for a wick ignition type oil burner which is adapted to not only vertically move a wick for the combustion or fire-extinguishing of the oil burner but variably set the vertical position of the wick.

2. Description of the Prior Art

In a wick ignition type oil burner, a wick is deteriorated with time, resulting in the fuel oil sucking-up capability of the wick being decreased. Also, the use of substandard fuel oil causes tar to be accumulated on a wick, particularly, on an upper end thereof, so that the wick may be substantially decreased in capability of vaporizing fuel oil therefrom. Such problems are solved by varying the vertical position of the wick to expose a fresh portion of the wick so that the vaporization and ignition of fuel oil may be carried out at the fresh portion. Unfortunately, a conventional wick actuating device of the lever actuation type for an oil burner fails to vary the vertical position of a wick without removing the wick from the oil burner.

Accordingly, it would be highly desirable to develop a wick actuating device of the lever actuation type for an oil burner which is capable of accomplishing variably setting the vertical position of a wick as desired without removing the wick from the oil burner.

SUMMARY OF THE INVENTION

Generally speaking, in accordance with the present invention, a wick actuating device of the lever actuation type for a wick ignition type oil burner is provided which includes a wick operating shaft rotatably mounted on the oil burner and operatedly connected to a wick received in a wick receiving cylinder of the oil burner so as to vertically move the wick when it is rotated. On the wick operating shaft is pivotally fitted a lever mechanism to actuate or rotate the wick operating shaft. The lever mechanism accomplishes not only the actuation or rotation of the wick operating shaft for the combustion or fire-extinguishing of the oil burner but the actuation of the wick operating shaft for variably setting the vertical position of the wick.

In a preferred embodiment of the present invention, the lever mechanism comprises a first lever loosely fitted on the wick operating shaft so as to be pivoted about the wick operating shaft, a second lever fixedly fitted on the wick operating shaft so as to be pivoted about the wick operating shaft, and a connection means for operatedly connecting the first lever to the second lever so that the pivotal movement of the first lever for vertically moving the wick to carry out the combustion or fire-extinguishing of the oil burner may be transmitted through the second lever to the wick operating shaft and the engagement between the first lever and the second lever may be made at a varied angle while keeping the first lever stationary, to thereby cause the vertical position of the wick to be variably set. The connection means may comprise a slit formed at one of the first and second levers and a pin slidably mounted on the other of the first and second levers so as to be positionally variably set on said the other lever in the axial direction thereof and movably fitted in the slit, and the slit is formed to be oblique with respect to the sliding direction of the pin so that the first and second levers may be engaged with each other through the pin and slit at an angle varied depending upon the position of the pin in the slit.

The first lever may be manually pivoted through a manual operation means.

Accordingly, it is an object of the present invention to provide a wick actuating device of the lever actuation type for an oil burner which is capable of variably setting the vertical position of a wick as desired without removing the wick from the oil burner.

It is another object of the present invention to provide a wick actuating device of the lever actuation type for an oil burner which is capable of not only accomplishing the vertical movement of wick for the combustion or fire-extinguishing of the oil burner but variably setting the vertical position of the wick by only the actuation of a wick operating shaft.

It is a further object of the present invention to provide a wick actuating device of the lever actuation type for an oil burner which is capable of variably setting the vertical position of a wick with simple operation.

It is still another object of the present invention to provide a wick actuating device of the lever actuation type for an oil burner which is capable of accomplishing the above-noted objects with a simple structure.

It is yet another object of the present invention to provide a wick actuating device of the lever actuation type for an oil burner which is capable of finely vertically moving a wick to readily carry out the optimum normal combustion of the oil burner.

It is still a further object of the present invention to provide a wick actuating device of the lever actuation type for an oil burner which is capable of accomplishing the fire-extinguishing when an emergency such as earthquake occurs.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein.

DETAILED DESCRIPTION OF THE PREFERRED EMBODIMENTS

Now, a wick actuating device of the lever actuation type for a wick ignition type oil burner according to the present invention will be described hereinafter with reference to the accompanying drawings.

Figure 1:
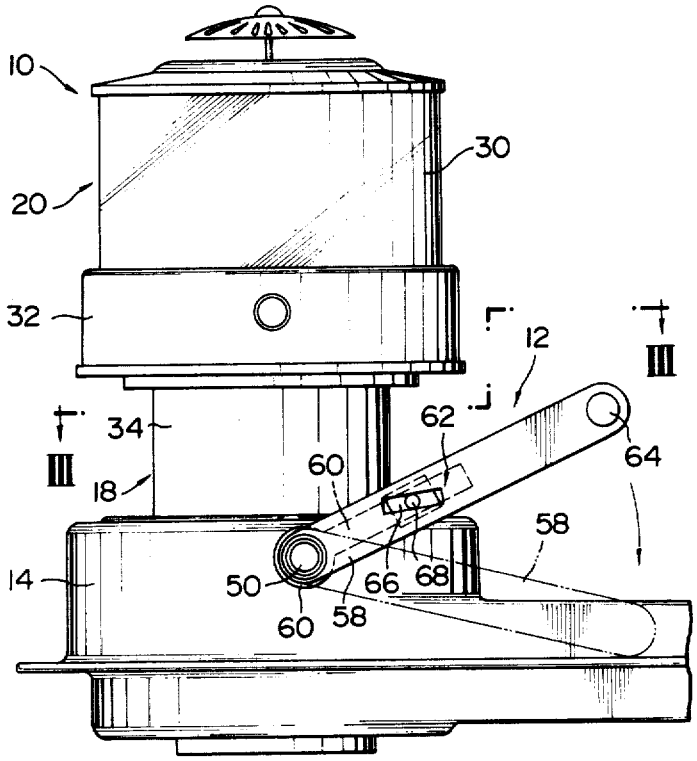
FIG. 1 is a front elevation view showing an oil burner in which an embodiment of a wick actuating device of the lever actuation type according to the present invention is incorporated.
Figure 2:
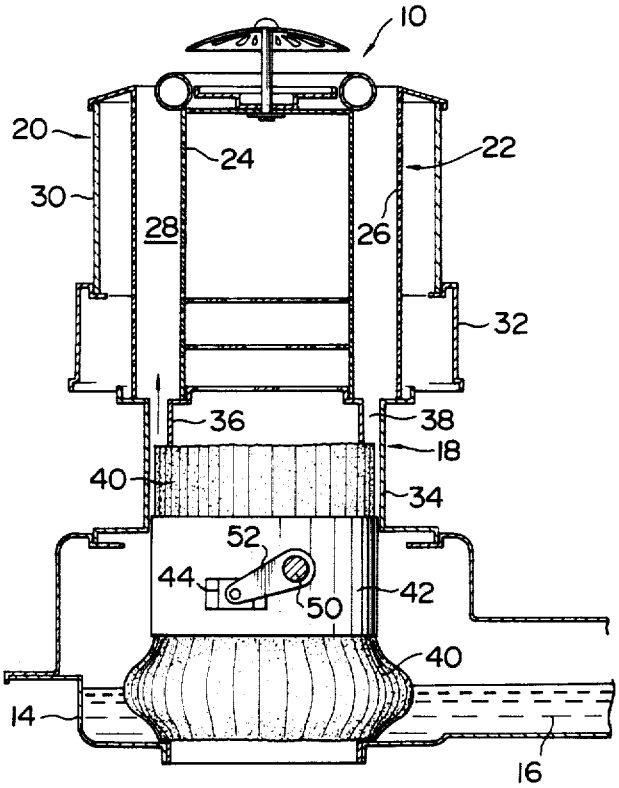
FIG. 2 is a vertical sectional view of the oil burner shown in FIG. 1.

FIGS. 1 and 2 illustrate a wick ignition type oil burner in which an embodiment of a wick actuating device of the lever actuation type is incorporated. In FIGS. 1 and 2, an oil burner and a wick actuating device according to the present invention are generally designated by reference numerals 10 and 12, respectively. The oil burner 10 is a red-hot type spac heater. However, it should be noted that an oil burner in which a wick actuating device of the present invention is to be incorporated is not limited to such a red-hot type space heater.

First, the oil burner 10 will be briefly described with reference to FIGS. 1 and 2.

The oil burner 10 itself is constructed in such a manner as widely known in the art. The oil burner 10 generally comprises an oil reservoir 14 for storing fuel oil 16 such as kerosene therein, a wick receiving cylinder 18 positioned on the oil reservoir 14 and a combustion cylinder construction 20 arranged on the wick receiving cylinder 18.

The combustion cylinder construction 20 includes a double combustion cylinder 22 comprising an inner perforated cylindrical member 24 and an outer perforated cylindrical member 26 which are arranged to define an annular space 28 therebetween. The combustion cylinder construction 20 also includes a heat-permeable cylinder 30 supported through a non-permeable cylinder 32 on the wick receiving cylinder 18 so as to surround the double combustion cylinder 22.

The wick receiving cylinder 18 has an outer wall 34 and inner wall 36 arranged to define therebetween an annular chamber 38 for receiving a wick 40 therein so as to communicate with the oil reservoir 14 and the annular space 28. The wick 40 is constantly dipped at a lower portion thereof in the fuel oil 16 in the oil reservoir 14 and vertically moved at an upper portion thereof as described below. When combustion is to be carried out, the wick 40 is raised at an upper end thereof to a lower portion of the space 28 as indicated at an arrow in FIG. 2. The wick 40 is supported at an intermediate portion thereof on an annular retaining plate 42 which is arranged in the oil reservoir 14 and wick receiving chamber 38 so as to be vertically moved therein. The wick retaining plate 42 is provided on an outer surface thereof with a connection member 44 of a substantially U-shape through which the wick retaining plate 42 is operatedly connected to the wick actuating device 12 of the present invention as described below.

In the oil burner 10 constructed as described above, when the wick 40 is raised to an ignition position and ignited, combustion starts in the space 28 to red-heat the inner and outer cylindrical members 24 and 26. Heat rays emitted from the red-heated cylindrical members are discharged through the heat-permeable cylinder 30 to a room and combustion gas of a high temperature produced in the space 28 is discharged through a top of the space 28 to the room.

The wick actuating device 12 of the illustrated embodiment will be described in detail with reference to FIGS. 1 to 3.

Figure 3:
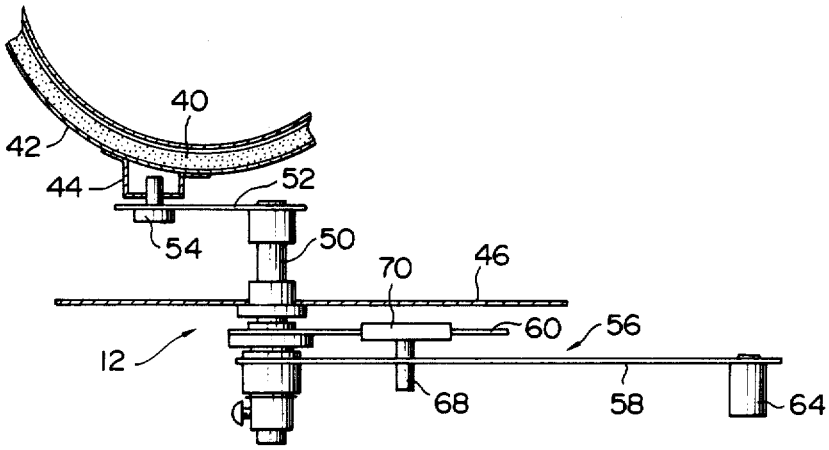
FIG. 3 is a sectional view taken along line III—III of FIG. 1.

The wick actuating device 12 includes a wick operating shaft 50 rotatably mounted on a frame 46 of the oil burner 10, as shown in FIG. 3. The wick operating shaft 50 is provided at one end thereof with a connection lever 52. The connection lever 52 is securely fitted at one end thereof on the wick operating shaft 50 and provided at the other end thereof with a pin 54 which is connected to the connection member 44 of the wick retaining plate 42. Thus, when the wick operating shaft 50 is rotated, the wick retaining plate 42 is vertically moved through the connection lever 52, pin 54 and connection member 44 to vertically move the wick 40.

The wick actuating device 12 of the illustrated embodiment also includes a lever mechanism 56 pivotally fitted on the wick operating shaft 50. The lever mechanism 56 is adapted to accomplish the actuation or rotation of the wick operating shaft 50 for the fire-extinguishing or combustion of the oil burner and the actuation or rotation of the wick operation shaft 50 for variably setting the vertical position of the wick 50. In the illustrated embodiment, the lever mechanism 56 comprises an operation lever 58 loosely fitted at one end thereof on the wick operating shaft 50, a shaft actuation lever 60 fixedly fitted at one end thereof on the wick operating shaft 50, and a connection means 62 (FIG. 1) operatedly connecting the operation lever 58 to the shaft actuation lever 60. The operation lever 58 is provided at the other end thereof with a manual operation means or knob 64 through which the operation lever 58 is pivoted about the wick operating shaft 50. The connection means 62 is adapted to connect the levers 58 and 60 to each other in a manner to transmit the pivotal movement of the operation lever 58 through the shaft actuation lever 60 to the wick operating shaft 50 to vertically move the wick 42 and to provide a limited pivotal movement of the shaft actuation lever 60 independent from the operation lever 58, while keeping the operation lever 58 stationary, to thereby variably set the ignition position of the wick 42. For this purpose, in the illustrated embodiment, the connection means 62 comprises a slit 66 formed at the operation lever 58 and a pin 68 slidably mounted on the shaft actuation lever 60 to be positionally variably set on the lever 60 in the axial direction thereof and movably fitted in the slit 66. The slit 66 is formed to obliquely extend at an angle with respect to the sliding direction of the pin. The angle is preferably small. In the illustrated embodiment, the pin 68 is mounted on a slider 70 slidably fitted on the shaft actuation lever 60 so as to be positionally variably set on the lever 60. Such construction of the connection means 62 causes the operation lever 58 to be engaged with the shaft actuation lever 60 through the pin 68 and slit 66 at an angle varied depending upon the position of the pin 68 in the slit 66. Thus, it will be noted that the connection means 62 not only causes the pivotal movement of the operation lever 58 through the manual knob 64 to be transmitted through the engagement between the pin 68 and the slit 66 to the shaft actuation lever 60 and then to the wick operating shaft 50 to vertically move the wick 40, but also allows the shaft actuation lever 60 to be pivotally moved independent from the operation lever 58 due to the sliding movement of the pin 68 in the slit 66 while keeping the operation lever 58 stationary. In the illustrated embodiment, when the operation lever 58 is pivoted as indicated at an arrow in FIG. 1, the wick 40 is raised form its extinguished position to its ingnition position. A position at which the pivotal movement of the operation lever 58 in the wick raising direction terminates may be determined to be constant in a conventional manner using any suitable means such as a scale indication, or an engagement of the operation lever 58 with a stopper in an emergency fire-extinguishing mechanism of the oil burner as described hereinafterwith reference to FIG 4. Because the shaft actuation.-lever 60, as described above, may be pivoted a limited amount independent from the operation lever 58, the ignition position of the wick can be varied a corresponding amount by moving the pin 68 in the slit while keeping the operation lever 58 stationary at the pivotal movement termination position of the operation lever 58.

In the illustrated embodiment, the slit 66 is formed at the operation lever 58 and the pin 68 is mounted on the shaft actuation lever 60. However, it will be readily understood to those skilled in the art that the same function may be accomplished also by forming the slit 66 at the shaft actuation lever 60 and providing the operation lever 58 with the pin 68.

In the embodiment described above, the manual operation means 64 for pivotally moving the operation lever 58 comprises the knob mounted on the other end of the operation lever, so that it may define an arcuate locus. However, the manual operation means is not limited to such a structure.

Figure 4:
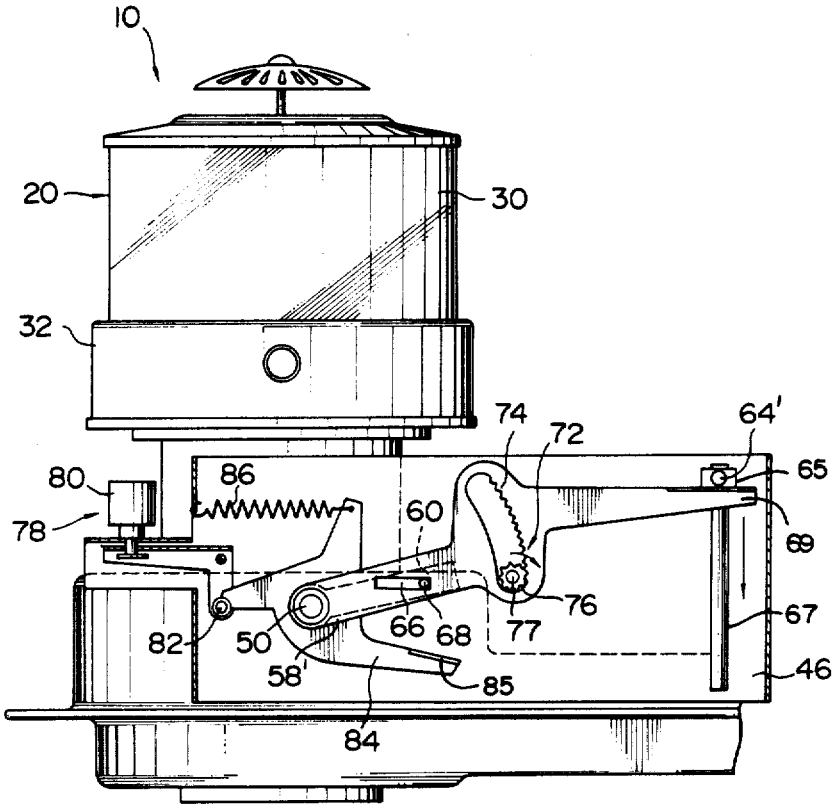
FIG. 4 is a front elevation view showing another embodiment of a wick actuating device of the lever actuation type for an oil burner according to the present invention.

FIG. 4 shows another embodiment of a wick actuating device of the lever actuation type for an oil burner according to the present invention. In the embodiment shown in FIG. 4, a manual operation means comprises a knob 64' carried by a slide 65 linearly movably mounted on a rod 67 secured to the frame 46 of the oil burner 10 by conventional fastening means (now shown). In the illustrated embodiment, the knob 64' is vertically moved and slidingly engaged with an outer end portion 69 of the operation lever 58'.

In the embodiment of FIG. 4, another manual operation means generally designated by reference numeral 72 is also provided. The manual operation means 72 comprises a rack 74 formed at the operation lever 58' and a manual operation pinion 76 rotatably mounted on the frame 46 and engaged with the rack 74 to pivotally move the operation lever 58 about a wick operating shaft 50. Mounted on the pinion 76 is a rotary knob 77 through which the pinion 76 is rotated. The knob 64' may be used for vertically moving a wick (not shown) and the rack-pinion mechanism 72 may be used for the fine vertical movement of the wick. Alternatively, the manual operation means 72 may be substituted for the manual operation means 64'. In this case, the manual operation means are used for both the rough vertical movement of the wick and the fine vertical movement.

In the embodiment of FIG. 4, the operation lever 58' is also operatedly connected to an emergency fire-extinguishing mechanism provided at the oil burner and generally designated by reference numeral 78. Like reference numerals in FIG. 4 designate parts that are like or correspond to those in FIGS. 1-3. Thus, lever 58' is loosely fitted at one end thereof on wick operation shaft 50 and is operatedly connected to this shaft through pin 68, slider 70 and lever 60 in the same manner as lever 58 in FIG. 1-3. The emergency fire-extinguishing mechanism 78 is to carry out the fire-extinguishing when an emergency such as earthquake or the like occurs and includes a vibration sensing weight 80 supported on the frame 46 and a stopper 82 connected at one end thereof to a lower end of the vibration sensing weight 80 and normally engaged at the other end thereof with a lever 84 which is loosely fitted intermediate to its ends on the wick operating shaft 50 as is well-known in the art. One end of lever 84 engages the stopper 82 and the other end of lever 84 carries a laterally projecting ledge 85 which causes levers 84 and 58' to be operatedly connected so as to pivot together when ledge 85 engages the underside of operation lever 58'. Reference numeral 86 is a coiled spring which acts to constantly urge the lever 84 to ensure the engagement of the lever 84 with the stopper 82. The operation lever 58' is operatedly connected to the lever 84 so that the operation lever 58' will be rotated in the wick lowering direction when the vibration sensing weight 80 is actuated to disengage the lever 84 from the stopper 82 spring 86 thereupon urging ledge 85 into engagement with the underside of operation lever 58' . The re-engagement between the stopper 82 and the lever 84 is carried out by, for example, downwardly moving the knob 64' as indicated at an arrow in FIG. 4 to pivotally move the operation lever 58' in the wick raising direction. Ledge 85 is maintained in engagement with the underside of operation lever 58' by spring 86 until re-engagement between lever 84 and stopper 82, after which operation lever 58' is movable independently of lever 84 as shown in FIG. 4.

As can be seen from the foregoing, the present invention not only accomplishes the vertical movement of a wick for the combustion or fire-extinguishing of an oil burner but variably sets the vertical position of the wick as desired with simple operation and without removing the wick from an oil burner.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A wick actuating device for an oil burner, comprising:

a wick operating shaft rotatably mounted on said oil burner; means for connecting said shaft to a wick received in said oil burner so as to vertically move said wick when when it is rotated;

operation means movable between a wick raised position and a wick lowered position;

actuation means connected to said wick operating shaft for causing rotation of said wick operating shaft to move said wick vertically between an ignition position to carry out combustion and an extingusished position to carry out fire-extinguishing of said oil burner; and, connection means for operatedly connecting said operation means and said actuation means to each so that movement of said operation means to said wick raised position or to said wick lowered position is transmitted through said actuation means to said wick operating shaft for vertically moving said wick respectively to said ignition position or to said extinguished position, said connection means including set means for causing said ingition position of said wick to be variably set relative to said wick raised position of said operation means.

2. A wick actuating device as defined in claimed 1, wherein;

said operation means comprises a first lever loosely fitted on said wick operating shaft so as to be pivoted about said wick operating shaft, said first lever being pivotally movable between said wick raised position and said wick lowered position;

said actuation means comprises a second lever fixedly fitted on said wick operating shaft so as to cause said rotation of said wick operating shaft; and, said connection means operatedly connects said first lever to said second lever so that the pivotal movement of said first lever for vertically moving said wick to carry out the combustion or fire-extinguishing of said oil burner is transmitted through said second lever to said wick operating shaft, and said set means varies the connection angle between said first lever and said second lever to cause the ignition position of said wick to be variably set.

3. A wick actuating device as defined in claim 2, wherein said set means comprises a slit formed at one of said first and second levers and a pin slidably mounted on the other of said first and second levers so as to be positionally variably set on said other lever in the axial direction thereof and movably fitted in said slit;

said slit being formed to be oblique with respect to the sliding direction of said pin so that said first and second levers are engaged with each other through said pin and slit at an angle which is varied depending upon the position of said pin in said slit.

4. A wick actuating device as defined in claim 2, wherein said first lever is actuated by means of a manual operation means so as to be pivoted about said wick operating shaft.

5. A wick actuating device of the lever actuation type for an oil burner, comprising:

a wick operating shaft rotatably mounted on said oil burner;

means for connecting said shaft to a wick received in said oil burner so as to vertically move said wick when it is rotated;

a first lever loosely fitted at one end thereof on said wick operating shaft so as to be pivoted about said wick operating shaft, siad first lever being pivotally movable between a wick raised position and a wick lowered position;

a second lever fixedly fitted at one end thereof on said wick operating shaft so as to cause rotation of said wick operating shaft to move said wick vertically between an ignition position to carry out combustion and an extinguished positon to carry out fire-extinguishing of said oil burner; and, connection means for operatedly connecting said first and second levers to each other so that pivotal movement of said first lever to said wick raised position or to said wick lowered position is transmitted through said second lever to said wick operating shaft for vertically moving said wick respectively to said ignition position or said extinguishing position, said connection means including set means forvarying the connection angle between said first lever and said second lever to cause the ignition position of said wick to be variably set relative to said wick raised position of the first lever.

6. A wick actuating device as defined in claim 5, wherein said set means comprises a slit formed in one of said first and second levers and a pin slidably mounted on the other of said first and second levers so as to be positionally variably set on said other lever in the axial direction thereof and movably fitted in said slit;

said slit being formed to be oblique with respect to the sliding direction of said pin so that said first and second levers are engaged with each other through said pin and slit at an angle which is varied depending upon the position of said pin in said slit.

7. A wick actuating device as defined in claim 5, wherein said first lever is pivoted through a manual operation means.

8. A wick actuating device as defined in claim 7, wherein said manual operation means comprises a knob mounted on the other end of said first lever.

9. A wick actuating device as defined in claim 7, wherein said manual operation means comprises a knob linearly movably mounted on said oil burner and engaged with the other end of said first lever.

10. A wick actuating device as defined in claim 7, wherein said manual operation means comprises a rack provided on said first lever and a manually operated pinion rotatably mounted on said oil burner and engaged with said rack.

11. A wick actuating device as defined in claim 6, wherein said slot is formed at said first lever and said pin is mounted on said second lever.

12. A wick actuating device as defined in claim 6, wherein said slot is formed in said second lever and said pin is mounted on said first lever.

13. A wick actuating device of the lever actuation type for an oil burner, comprising:

a wick operating shaft rotatably mounted on said oil burner;

means for connecting said shaft to a wick received in said oil burner so as to vertically move said wick when it is rotated;

an operation lever loosely fitted at one end thereof on said wick operating shaft so as to be pivoted about said wick operating shaft, said operating lever being pivotally movable between a wick raised position and a wick lowered position;

a shaft actuation lever fixedly fitted at one end thereof on said wick operating shaft so as to cause rotation of said wick operating shaft to move said wick vertically between an ignition position to carry out a combustion and an extinguished position to carry out fire-extinguishing of said oil burner;

a connection means for operatedly connecting said operation lever to said shaft actuation lever to each other so that movement of said operation lever to said wick raised position or to said wick lowered position is transmitted through said actuation lever to said wick operating shaft for vertically moving said wick respectively to said ignition position or to said extinguished position, said connection means including set means for causing said ignition position of said wick to be variably set relative to said wick raised position of said operation lever;

said set means comprising a slit formed in said operation lever and a pin slidably mounted on said shaft actuation lever so as to be positionally variably set on said shaft actuation lever in the axial direction thereof and movably fitted in said slit, said slit being formed to be oblique with respect to the sliding direction of said pin so that said operation lever and said shaft actuation lever are engaged with each other through said pin and slit at an angle which is varied depending upon the position of said pin in said slit.

14. A wick actuating device as defined in claim 13, wherein said operation lever is pivoted through a manual operation means.

15. A wick actuating device as defined in claim 14, wherein said manual operation means comprises a knob mounted on the other end of said operation lever.

16. A wick actuating device as defined in claim 14, wherein said manual operation means comprises a knob linearly movably mounted on said oil burner and engaged with said operation lever.

17. A wick actuating device as defined in claim 14, wherein said manual operation means comprises a rack provided at said operation lever and a manually operated pinion rotatably mounted on said oil burner and engaged with said rack.

18. A wick actuating device as defined in claim 14 further comprising another manual operation means comprising a rack provided at said operation lever and a manually operated pinion rotatably mounted on said oil burner and engaged with said rack.

19. A wick actuating device as defined in claim 13, wherein said operation lever is operatedly connected to an emergency fire-extinguishing mechanism provided in said oil burner so as to be pivoted in the wick lowering direction when said emergency fire-extinguishing mechanism is actuated.

* * * * *

UNITED STATES PATENT AND TRADEMARK OFFICE

CERTIFICATE OF CORRECTION

PATENT NO. : 4,726,762

DATED : 02/23/88

INVENTOR(S) : Nakamura, et al.

It is certified that error appears in the above-identified patent and that said Letters Patent are hereby corrected as shown below:

Column 6, line 51, after "burner;" insert paragraph beginning with "means for...".

Column 6, line 53, delete second occurrence of "when".

Column 6, lines 59-60, correct spelling to --extinguished--.

Column 6, line 63, after "each" add --other--.

Column 7, line 49, after "shaft," correct spelling to --said--.

Column 7, line 66, insert a space between "for" and "varying".

Column 8, line 54, delete "a" before "connection".

Column 8, line 55, after "lever" delete "to" and insert --and--.

Signed and Sealed this

Fifth Day of July, 1988

*Attest:*

*Attesting Officer*

DONALD J. QUIGG

*Commissioner of Patents and Trademarks*